US005094200A

United States Patent [19]

Fontichiaro

[11] Patent Number: 5,094,200

[45] Date of Patent: Mar. 10, 1992

[54] LIGHTWEIGHT COMPOSITE ENGINE VALVE

[75] Inventor: Dominic Fontichiaro, Dearborn Heights, Mich.

[73] Assignee: Ford Motor Company, Dearborn, Mich.

[21] Appl. No.: 706,540

[22] Filed: May 28, 1991

[51] Int. Cl.[5] ..... F01L 3/02

[52] U.S. Cl. ..... 123/188.3; 123/188.1; 123/188.2; 251/368

[58] Field of Search ..... 123/188 A, 188 AA, 188 R; 251/321, 356, 368

[56] References Cited

U.S. PATENT DOCUMENTS

| | | | |
|---|---|---|---|
| 2,043,307 | 6/1936 | Scott | 49/81 |
| 2,664,874 | 1/1954 | Graham | 123/188 |
| 3,061,482 | 10/1962 | Grant | 65/59.1 |
| 3,073,294 | 1/1963 | Brown et al. | 123/188 |
| 3,328,145 | 6/1967 | McMillan et al. | 65/59.1 |
| 3,438,118 | 4/1969 | Milch et al. | 65/59.1 |
| 3,711,171 | 1/1973 | Orkin et al. | 308/241 |
| 4,050,956 | 9/1977 | de Bruin et al. | 65/59.1 |
| 4,149,910 | 4/1979 | Popplewell | 65/59.1 |
| 4,155,492 | 5/1979 | Seaton | 251/319 |
| 4,301,213 | 11/1981 | Davies | 384/907.1 |
| 4,359,022 | 11/1982 | Nakamura et al. | 123/188 AA |
| 4,410,285 | 10/1983 | Strasser et al. | 384/278 |
| 4,433,652 | 2/1984 | Holtzberg et al. | 123/188 AA |
| 4,556,022 | 12/1985 | Yamada et al. | 123/188 AA |
| 4,597,367 | 7/1986 | Hayashi | 251/368 |
| 4,770,549 | 9/1988 | Rokkaku et al. | 384/907.1 |
| 4,834,036 | 5/1989 | Nishiyama et al. | 123/188 AA |
| 4,846,837 | 7/1989 | Kurze et al. | 623/16 |
| 4,872,431 | 10/1989 | Akao et al. | 123/188 A |
| 4,881,500 | 11/1989 | Kojima et al. | 123/188 AA |
| 4,883,778 | 11/1989 | SinghDeo et al. | 623/16 |
| 4,928,645 | 5/1990 | Berneburg et al. | 123/188 AA |

OTHER PUBLICATIONS

*Ward's Engine and Vehicle Technology Update,* Nov. 1, 1990, "Closeup: New Ceramic Process Slashes Costs", vol. 16, No. 21, pp. 1 and 6.

*Primary Examiner*—E. Rollins Cross
*Assistant Examiner*—Erick Solis
*Attorney, Agent, or Firm*—Joseph W. Malleck; Clifford L. Sadler

[57] ABSTRACT

A composite intake or exhaust valve for an internal combustion engine is disclosed. The composite engine valve comprises a valve head of lightweight, heat resistant metal alloy material and a valve stem of lightweight, heat resistant ceramic based material. The valve head has an integral valve head insert around which the valve stem is molded to integrate the valve head and valve stem into a composite valve. The valve head insert is provided with anti-rotation means to prevent rotation of the valve head relative to the valve stem during use. The valve head insert is also provided with anti-tension means to prevent separation of the valve head from the valve stem during use.

20 Claims, 1 Drawing Sheet

LIGHTWEIGHT COMPOSITE ENGINE VALVE

TECHNICAL FIELD

The present invention relates generally to internal combustion engines. Specifically, the invention relates to a composite intake or exhaust valve for an internal combustion engine.

BACKGROUND OF THE INVENTION

An increasingly important goal in the automotive industry is improved fuel efficiency. This goal is accomplished, in part, through the use of lightweight materials in the construction of vehicle component parts. Lightweight parts are increasingly used in the internal combustion engine itself. This includes the use of lightweight intake and exhaust valves. In addition to reducing fuel comsumption, lightweight engine valves can also enhance high speed engine performance.

Construction of lightweight engine valves has been approached in a number of different ways. U.S. Pat. Nos. 4,928,645 to Berneburg et al and 4,881,500 to Kojima et al disclose engine valves constructed from ceramic materials. U.S. Pat. No. 4,834,036 to Nishiyama et al discloses a composite engine valve having various parts constructed from titanium aluminum alloys and steel. U.S. Pat. No. 4,433,652 to Holtzberg et al discloses a composite engine valve having parts constructed from titanium, steel, or aluminum as well as thermoplastics Each of the above noted inventions succeed in reducing the weight of the engine valve. However, each also suffer various problems For example, engine valves having ceramic valve heads are less able to withstand wear resulting from repetitive pounding against the valve seat. This problem can be solved through the use of composite engine valves having metal alloy valve heads combined with a valve stem of lightweight materials or construction. Known composite engine valves, however, suffer from inherent problems associated with tension and rotational forces acting upon the joint between the valve head and the valve stem.

These and other problems encountered by the prior art are addressed by the invention as described below.

SUMMARY OF THE INVENTION

According to one aspect of the present invention, a composite engine valve is disclosed which comprises a valve head of substantially lightweight, heat resistant metal alloy material and a valve stem of substantially lightweight, heat resistant ceramic based material. Extending from the valve head is an integral valve head insert. The composite engine valve is integrated by molding the valve stem about the valve head insert so that the valve head and valve insert are permanently fixed to each other. The valve head insert is provided with anti-rotation means to prevent rotation of the valve head relative to the valve stem during use. The valve head insert is also provided with anti-tension means to prevent separation of the valve head from the valve stem during use.

According to another aspect of the present invention, the composite engine valve may further comprise a valve cap of substantially lightweight, heat resistant metal alloy material. Extending from the valve cap is an integral valve cap insert. The composite engine valve is integrated by molding the valve stem about the valve cap insert so that the valve stem and the valve cap are permanently fixed to each other. The valve cap insert is provided with anti-tension means to prevent separation of the valve cap from the valve stem during use. The valve cap insert may also be provided with anti-rotation means to prevent rotation of the valve cap relative to the valve stem during use. The valve cap is especially useful when the valve stem is constructed from a ceramic-plastic matrix material because the metal alloy valve cap is better able to withstand wear caused by repeated abrasion of the rocker arm against the valve stem.

Accordingly, it is a principle object of this invention to provide a lightweight, heat resistant engine valve to enhance engine performance and reduce fuel consumption.

Another object of this invention is to provide an engine valve capable of withstanding wear resulting from repeated pounding of the valve head against the valve seat of the internal combustion engine.

Another object of this invention is to provide a composite engine valve capable of withstanding tension and rotational forces applied to the joint between the valve head and the valve stem.

Another object of this invention is to provide a composite engine valve capable of withstanding the wear resulting from repeated abrasion from the rocker arm against the valve stem.

Another object of this invention is to provide a composite engine valve that is simple and inexpensive to manufacture.

These and other features, objects and advantages will be apparent after consideration of the following description of the invention when taken in connection with the accompanying illustrative drawings.

BEST MODE FOR CARRYING OUT THE INVENTION

Figure 1:
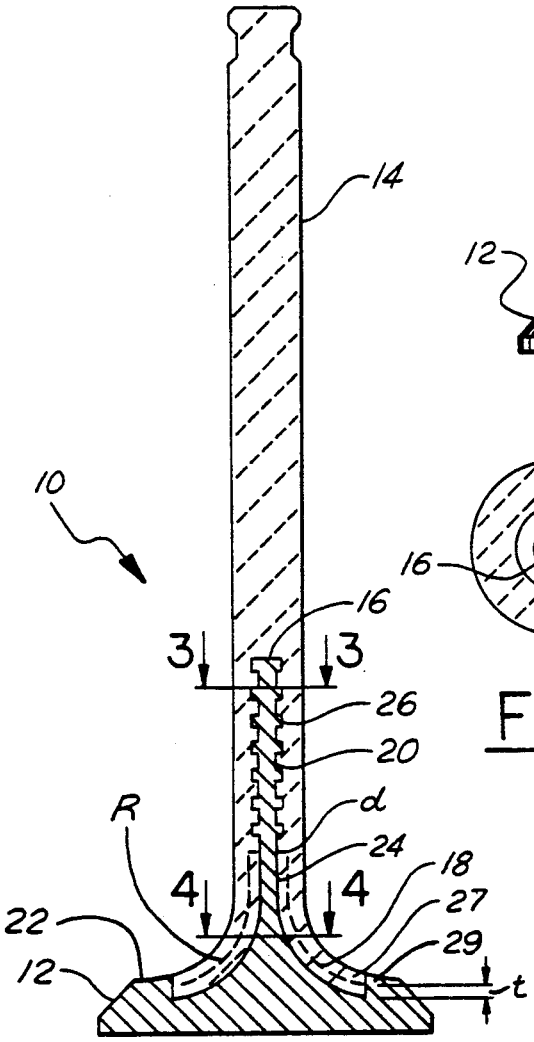
FIG. 1 is an elevational view in cross-section of the engine valve of the present invention.
Figure 2:
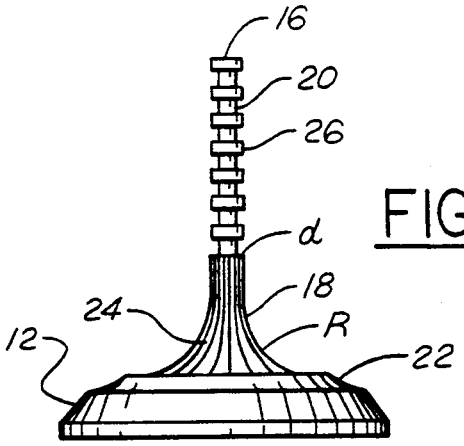
FIG. 2 is an elevational view of the valve head of the engine valve of the present invention.

As shown in FIG. 1, the composite engine valve 10 of the present invention has a titanium alloy valve head 12 in combination with a ceramic valve stem 14. A typical engine valve for an internal combustion engine composed of steel weighs 76.3 grams. The same valve constructed from titanium weighs 49.3 grams. The same engine valve composed of all ceramic material weighs 36.2 grams. The composite construction of the engine valve 10 of the present invention reduces the weight of the engine valve 10 below that of the equivalent all titanium engine valve. The composite engine valve 10 of the present invention also weighs approximately $\frac{1}{3}$ that of an equivalent all steel engine valve.

While the composite engine valve 10 of the present invention is not as light as an equivalent all ceramic valve, its composite construction successfully solves problems associated with an all ceramic engine valve. The titanium alloy valve head 12 has greater resistance than an all ceramic valve to wear caused by repeated pounding of the valve head 12 against the valve seat of an internal combustion engine. Thus, the lightweight composite engine valve 10 of the present invention helps reduce fuel consumption and enhance engine performance.

Figure 3:
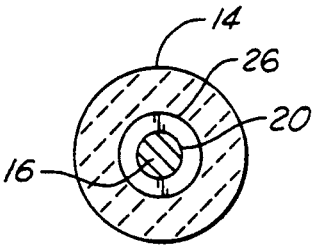
FIG. 3 is a cross-section of the engine valve taken along the line 3—3 in FIG. 1.

As shown in FIGS. 1–4, an integral valve head insert 16 extends from the valve head 12. The valve head insert 16 has a tapered portion 18 and a cylindrical portion 20. The tapered portion 18 follows an arcuate path of generally fixed radius R from the undersurface 22 of the valve head 12 to the cylindrical portion 20. The tapered portion 18 thus has a diameter that generally decreases in the direction away from the valve head 12 down to a minor diameter d proximate the cylindrical portion 20. The tapered portion 18 also has a plurality of longitudinal grooves 24 having a constant depth t throughout their length. The grooves 24 are equally spaced radially about the entire periphery of the tapered portion 18 and progressively increase in width in the direction towards the valve head 12 so as to produce a saw tooth configuration in cross-section as seen in FIG. 3 at any section taken in tapered portion 18 transversely of the valve axis. Such a grooved configuration is practical in a manufacturing sense where the valve head 12 is made of powdered metal. If the valve head 12 is of wrought material it is more practical to machine longitudinal grooves 24 of uniform width whereby the true saw tooth configuration will appear only at the minor diameter of the tapered portion 18.

The cylindrical portion 20 has a reduced diameter relative to the minor diameter d of the tapered portion 18. The cylindrical portion 20 also has a plurality of annular ribs 26 of equal diameter and length and equally spaced from one another. It is preferred the valve head insert 16 constitute approximately $\frac{1}{4}$ to $\frac{1}{3}$ of the total length of the engine valve 10 and that there be provided at least four to five ribs 26 and preferably six to eight. Preferably, the diameter of the annular ribs 26 is equal to that of the minor diameter d of the tapered portion 18 such that stress concentrations are maintained at a minimum at this juncture of valve stem 14 and valve head 12.

The valve head 12 and valve stem 14 are integrated into the composite engine valve 10 by molding the ceramic valve stem 14 around the valve head insert 16. A typical ceramic suitable for such purpose is silicon nitride. Other suitable ceramics include silica and silicon carbide. The molding process itself is not a part of the present invention but it is believed any conventional molding process will suffice as, for example, that shown and described in U.S. Pat. No. 4,928,645 to Berneburg, the subject matter of which is incorporated herein by reference.

Figure 4:
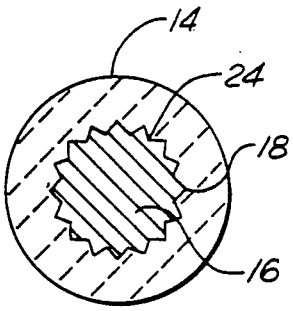
FIG. 4 is a cross-section of the engine valve taken along the line 4—4 in FIG. 1.

The juncture between the valve head 12 and the valve stem 14 is shown in cross-section in FIGS. 3 and 4. FIG. 3 shows the juncture between the valve stem 14 and the annular ribs 26. The valve stem 14 completely surrounds the annular ribs 26 which function as anti-tension means to prevent separation of the valve head 12 and the valve stem 14 during use of the composite engine valve 10. FIG. 4 shows the juncture of the valve stem 14 with the longitudinal grooves 24. The valve stem 14 completely fills the longitudinal grooves 24 which function as anti-rotation means to prevent rotation of the valve head 12 relative to the valve stem 14 during use of the composite engine valve 10. The composite engine valve 10 of the present invention thus successfully solves the inherent problem associated with composite engine valves of rotational and tension forces exerted upon the joint between the valve head 12 and the valve stem 14.

As shown in FIG. 1, the valve stem 14 and the valve head insert 16 are co-axial such that the wall thickness of the valve stem 14 remains constant from the outside diameter of the annular ribs 26 to the outside diameter of the valve stem 14. The wall thickness of the valve stem 14 about the valve head insert 16 is preferably uniform throughout its length across tapered portion 18. The valve stem 14 extends to the undersurface 22 of the valve head 12. The valve stem 14 forms a shoulder 27 at its termination point to prevent cracking that typically occurs in ceramic materials having a generally tapered thickness. The undersurface 22 of the valve head 12 is provided with a lip 29. The lip 29 abuts the shoulder 27 of the valve stem 14 thereby preserving a smooth outer surface on the composite engine valve 10. The valve stem 14 molded about the valve head insert 16 permanently fixes the valve head 12 and valve stem 14 relative to each other. The composite construction of the engine valve 10 also reduces the amount of titanium alloy needed to construct the composite engine valve 10. The net result is a decrease in the overall weight of the composite engine valve 10 while preserving the same outer silhouette of the valve 10 which is particularly important in the area of the tapered section to preserve the air flow efficiency across the valve port.

Figure 5:
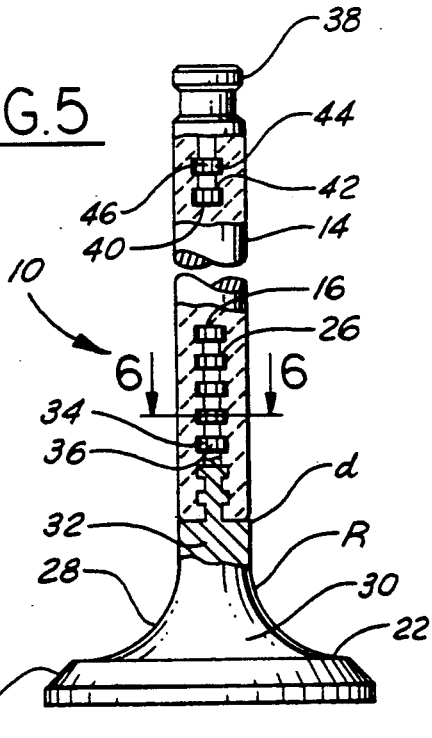
FIG. 5 is an elevational view in partial cross-section of an alternative embodiment of the engine valve of the present invention.
Figure 6:
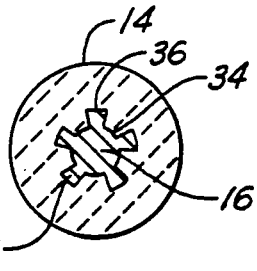
FIG. 6 is a cross-section of the engine valve taken along the line 6—6 in FIG. 5.

An alternative embodiment of the composite engine valve 10 of the present invention is shown in FIGS. 5 and 6. In this embodiment, an integral valve head stem 28 extends from the valve head 12. The valve head stem 28 has a tapered portion 30 and a stem portion 32. The tapered portion 30 follows an arcuate path of generally fixed radius R from the undersurface 22 of the valve head 12 to the stem portion 32. The tapered portion 30 thus has a diameter that generally decreases in the direction away from the valve head 12 down to a minor diameter d proximate the stem portion 32. The minor diameter d of the tapered portion 30 is equal to the outside diameter of the valve stem 14.

In this embodiment, the integral valve head insert 16 extends from the stem portion 32 of the valve head stem 28. The valve head insert 16 has a reduced diameter relative to the stem portion 32. The valve head insert 16 is still provided with a plurality of annular ribs 26 which function as anti-tension means to prevent separation of the valve head 12 and the valve stem 14 during use of the composite engine valve 10. The annular ribs 26 are again of equal diameter and length and equally spaced from one another. It is preferred the valve head insert 16 constitute approximately $\frac{1}{3}$ to $\frac{1}{2}$ of the total length of the engine valve 10 and that there be provided at least four to five ribs 26 and preferably six to eight.

The valve head insert 16 is also still provided with anti-rotation means to prevent the valve head 12 from rotating relative to the valve stem 14. The anti-rotation means take the form of a plurality of slots 34 in the annular ribs 26 of the valve head insert 16. FIG. 6 shows the slots 34 in cross-section. The cutting or casting of the slots 34 in the annular ribs 26 leaves complementary flanges 36 in the annular ribs 26. The slots 34 have a width generally equal to the flanges 36. The location of the slots 34 and flanges 36 on each annular rib 26 can also be progressively offset at some fixed angle relative to the slots 34 and flanges 36 on a designated base annular rib 26. Such an offset further increases the ability of the composite engine valve 10 to withstand tension forces particularly.

In this embodiment, the valve stem 14 is again molded around the valve head insert 16 to permanently fix the valve head 12 and valve stem 14 relative to each other. The valve stem 14 completely surrounds the annular ribs 26 to prevent separation of the valve head 12 and the valve stem 14 during use of the composite engine valve 10. The valve stem 14 also completely fills the slots 34 to prevent rotation of the valve head 12 relative to the valve stem 14 during use of the composite engine valve 10. The valve stem 14 and the valve head insert 16 are again co-axial such that the wall thickness of the valve stem 14 remains constant from the outside diameter of the annular ribs 26 to the outside diameter of the valve stem 14.

The valve stem 14 of the composite engine valve 10 may be constructed from a ceramic-plastic matrix material to further reduce overall weight. The wear resistance of ceramic-plastic matrix material is not as great as that of ceramic alone. Because of this, the end of the valve stem 14 which will contact the engine rocker arm and be subjected to repeated abrasion from the engine rocker arm is preferably replaced with a titanium alloy valve cap 38.

As shown in FIG. 5, an integral valve cap insert 40 depends from the valve cap 38. The valve cap insert 40 has a plurality of annular ribs 42. The annular ribs 42 are provided with a plurality of slots 44 and complementary flanges 46 indentical to those of the valve head insert 22, i.e., ribs 26, slots 34 and flanges 36, respectively. The valve head 12, valve cap 38 and valve stem 14 are integrated into the composite engine valve 10 of the present invention by molding the valve stem 14 about the valve head insert 16 and the valve cap insert 40. The valve stem 14 terminates proximate the valve head stem 28 and the valve cap 38, respectively. The valve stem 14 completely surrounds the annular ribs 26, 42 and completely fills the slots 34, 44 of the valve head insert 16 and the valve cap insert 40, respectively. The annular ribs 26, 42 function as anti-tension means to prevent separation of the valve cap 38, valve stem 14 and valve head 12 during use of the composite engine valve 10. The slots 34, 44 function as anti-rotation means to prevent rotation of the valve cap 38, valve stem 14 and valve head 12 relative to one another during use of the composite engine valve 10. The valve cap 38, valve stem 14 and valve head 12 are thereby permanently fixed relative to one other.

While the best mode for carrying out the invention has been described in detail, those familiar with the art to which this invention relates will recognize various alternative designs and embodiments for practicing the invention as defined by the following claims.

I claim:

1. A composite engine valve for use within a combustion chamber having a valve seat, said composite engine valve comprising:

a valve head of substantially lightweight, heat resistant metal alloy material;

a valve head insert of substantially lightweight, heat resistant metal alloy material integrally extending from said valve head and having head anti-rotation means for resisting rotational forces on the valve head during operation as said valve head impacts the valve seat within the combustion chamber, and head anti-tension means for resisting tension forces on said valve head during operation as said valve head is returned to a normally closed biased position on the valve seat within the combustion chamber; and a valve stem of substantially lightweight, heat resistant ceramic base material molded about said valve head insert and receiving said head anti-rotation means and said head anti-tension means whereby said valve head and valve stem are permanently fixed relative to each other.

2. The composite engine valve of claim 1 further comprising:

a valve cap of substantially lightweight, heat resistant metal alloy material;

a valve cap insert of substantially lightweight, heat resistant metal alloy material integrally extending from said valve cap, said valve cap insert having cap anti-tension means for resisting tension forces and cap anti-rotation means for resisting rotational forces, said valve stem being molded about said valve cap insert and receiving said cap anti-tension means and said cap anti-rotation means whereby said valve cap and said valve stem are permanently fixed relative to each other.

3. The composite engine valve of claim 1 wherein:

said head anti-tension means comprises a plurality of annular ribs in said valve head insert; and said head anti-rotation means comprises a plurality of circumferentially equally spaced longitudinal grooves in said valve head insert.

4. The composite engine valve of claim 2 wherein;

said cap anti-tension means comprises a plurality of annular ribs in said valve cap insert; and said cap anti-rotation means comprises a plurality of circumferentially equally spaced slots and complementary flanges in said annular ribs of said valve cap insert.

5. The composite engine valve of claim 4 wherein said slots and flanges in said annular ribs of said valve cap insert have approximately equal widths.

6. The composite engine valve of claim 1 wherein:

said valve head and said valve head insert are a titanium alloy material; and said valve stem is a ceramic-plastic matrix material.

7. The composite engine valve of claim 2 wherein said valve cap and said valve cap insert are a titanium alloy material.

8. A composite engine valve for use within a combustion chamber having a valve seat, said composite engine valve comprising:

a valve head of substantially lightweight, heat resistant metal alloy material having an undersurface that sealingly engages the valve seat;

a valve head insert of substantially lightweight, heat resistant metal alloy material integrally extending from said valve head, said valve head insert having a tapered portion extending from said valve head, a cylindrical portion extending from said tapered portion, head anti-rotation means for resisting rotational forces on said valve head during operation as said valve head impacts the valve seat within the combustion chamber, and head anti-tension means for resisting tension forces on said valve head during operation as said valve head is returned to a normally closed biased position on the valve seat within the combustion chamber, wherein said tapered portion of said valve head insert follows an arcuate path of generally fixed radius from said undersurface of said valve head to said cylindrical portion of said valve head insert; and a valve stem of substantially lightweight, heat resistant ceramic base material molded about said valve head insert and receiving said head anti-rotation means and said head anti-tension means whereby said valve head and valve stem are permanently fixed relative to each other.

9. The composite engine valve of claim 8 further comprising:

a valve cap of substantially lightweight, heat resistant metal alloy material;

a valve cap insert of substantially lightweight, heat resistant metal alloy material integrally extending from said valve cap, said valve cap insert having cap anti-tension means for resisting tension forces and cap anti-rotation means for resisting rotational forces, said valve stem being molded about said valve cap insert and receiving said cap anti-tension means and said cap anti-rotation means whereby said valve cap and said valve stem are permanently fixed relative to each other.

10. The composite engine valve of claim 8 wherein:

said head anti-tension means comprises a plurality of annular ribs in said generally cylindrical portion of said valve head insert; and said head anti-rotation means comprises a plurality of circumferentially equally spaced longitudinal grooves in said tapered portion of said valve head insert.

11. The composite engine valve of claim 9 wherein:

said cap anti-tension means comprises a plurality of annular ribs in said valve cap insert; and said cap anti-rotation means comprises a plurality of circumferentially equally spaced slots and complementary flanges in said annular ribs of said valve cap insert.

12. The composite engine valve of claim 11 wherein said slots and flanges in said annular ribs of said valve cap insert have approximately equal widths.

13. The composite engine valve of claim 8 wherein:

said valve head and said valve head insert are a titanium alloy material; and said valve stem is a ceramic-plastic matrix material.

14. The composite engine valve of claim 9 wherein said valve cap and said valve cap insert are a titanium alloy material.

15. A composite engine valve for use within a combustion chamber having a valve seat, said composite engine valve comprising:

a valve head of substantially lightweight, heat resistant metal alloy material having an undersurface that sealingly engages the valve seat;

a valve head stem of substantially lightweight, heat resistant metal alloy material integrally extending from said valve head, said valve head stem having a tapered portion extending from said valve head and a stem portion extending from said tapered portion wherein said tapered portion of said valve head stem follows an arcuate path of generally fixed radius from said undersurface of said valve head to said stem portion of said valve head stem;

a valve head insert of substantially lightweight, heat resistant metal alloy material integrally extending from said stem portion of said valve head stem, said valve head insert having a reduced diameter relative to said stem portion, head anti-tension means for resisting tension forces on said valve head during operation as said valve head impacts the valve seat within the combustion chamber, and head anti-tension means for resisting tension forces on said valve head during operation as said valve head is returned to a normally closed biased position on the valve seat within the combustion chamber; and a valve stem of substantially lightweight, heat resistant ceramic base material having an outside diameter equal to that of said stem portion of said valve head stem, said valve stem being molded about said valve head insert and receiving said head anti-rotation means and said head anti-tension means whereby said valve head and valve stem are permanently fixed relative to each other.

16. The composite engine valve of claim 15 wherein:

said valve head, valve head stem and said valve head insert are a titanium alloy material; and said valve stem is a ceramic-plastic matrix material.

17. The composite engine valve of claim 15 wherein:

said head anti-tension means comprises a plurality of annular ribs in said valve head insert;

said head anti-rotation means comprises a plurality of circumferentially equally spaced slots and complementary flanges in said annular ribs of said valve head insert; and said slots and flanges in said annular ribs of said valve head insert having approximately equal widths.

18. The composite engine valve of claim 15 further comprising:

a valve cap of substantially lightweight, heat resistant metal alloy material and including;

a valve cap insert integrally extending from said valve cap;

said valve cap insert having cap anti-tension means for resisting tension forces and cap anti-rotation means for resisting rotational forces, said valve stem being molded about said valve cap insert and receiving said cap anti-tension means and said cap anti-rotation means whereby said valve cap and valve stem are permanently fixed relative to each other;

said cap anti-tension means comprises a plurality of annular ribs in said valve cap insert; and said cap anti-rotation means comprises a plurality of circumferentially equally spaced slots and complementary flanges in said annular ribs of said valve cap insert.

19. The composite engine valve of claim 16 wherein said slots and flanges in said annular ribs of said valve cap insert have approximately equal widths.

20. The composite engine valve of claim 18 wherein said valve cap and said valve cap stem are a titanium alloy material.

* * * * *

UNITED STATES PATENT AND TRADEMARK OFFICE

CERTIFICATE OF CORRECTION

PATENT NO. : 5,094,200
DATED : March 10, 1992
INVENTOR(S) : Fontichiaro, Dominic It is certified that error appears in the above-identified patent and that said Letters Patent is hereby corrected as shown below:

Column 8,
Line 7, - Replace "anti-tension" with -- anti-rotation --.
Line 8, - Replace "tension" with -- rotational --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*